United States Patent [19]

Huang

[11] Patent Number: 4,884,555

[45] Date of Patent: Dec. 5, 1989

[54] SWIRL COMBUSTER BURNER

[75] Inventor: Vincent M. S. Huang, Brookfield, Wis.

[73] Assignee: A. O. Smith Corporation, Milwaukee, Wis.

[21] Appl. No.: 274,471

[22] Filed: Nov. 21, 1988

[51] Int. Cl.[4] ..... F24H 1/00

[52] U.S. Cl. ..... 126/350 R; 126/351; 126/361; 431/183

[58] Field of Search ..... 126/361, 350 R, 351; 431/182, 183, 185; 122/14, 17, 23

[56] References Cited

U.S. PATENT DOCUMENTS

| | | | |
|---|---|---|---|
| 1,147,499 | 7/1915 | Fukuzumi | 126/361 |
| 1,994,461 | 3/1935 | Boland | 431/183 |
| 2,335,918 | 12/1943 | Davis et al. | 126/350 R |
| 3,887,325 | 6/1975 | Finger et al. | 126/351 |
| 4,221,558 | 9/1980 | Santisi | 431/183 |
| 4,297,093 | 10/1981 | Morimoto et al. | 431/182 |

*Primary Examiner*—Ira S. Lazarus
*Assistant Examiner*—Christopher Hayes
*Attorney, Agent, or Firm*—Niro, Scavone, Haller & Niro, Ltd.

[57] ABSTRACT

An improved high efficiency swirl combustor type gas burner for use in residential or commercial water heaters is provided having a swirl cone to induce turbulence in the combustion air and a mixing zone where turbulent gas is mixed with the combustion air and then combusted at a distance away from the burner face.

9 Claims, 2 Drawing Sheets

FIG. 2
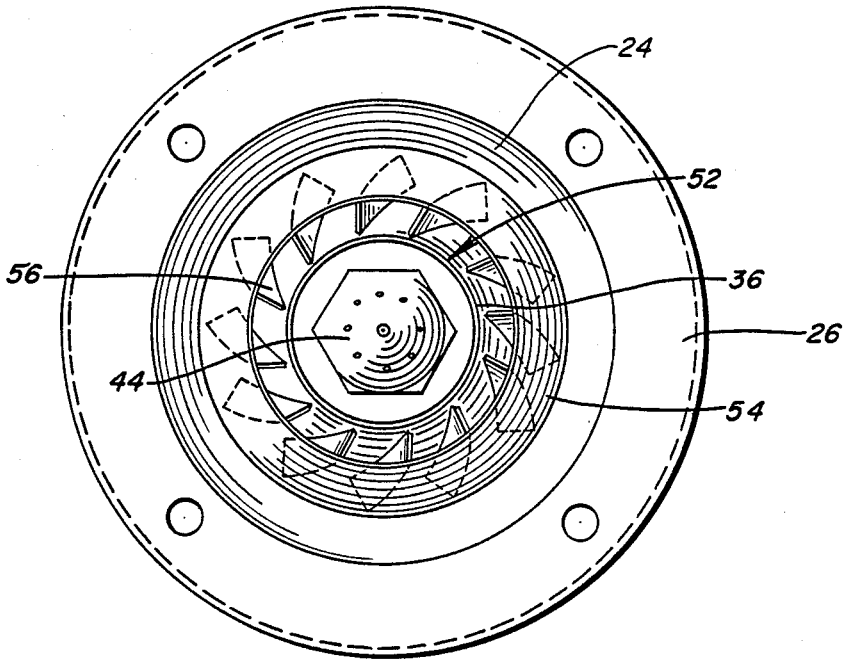
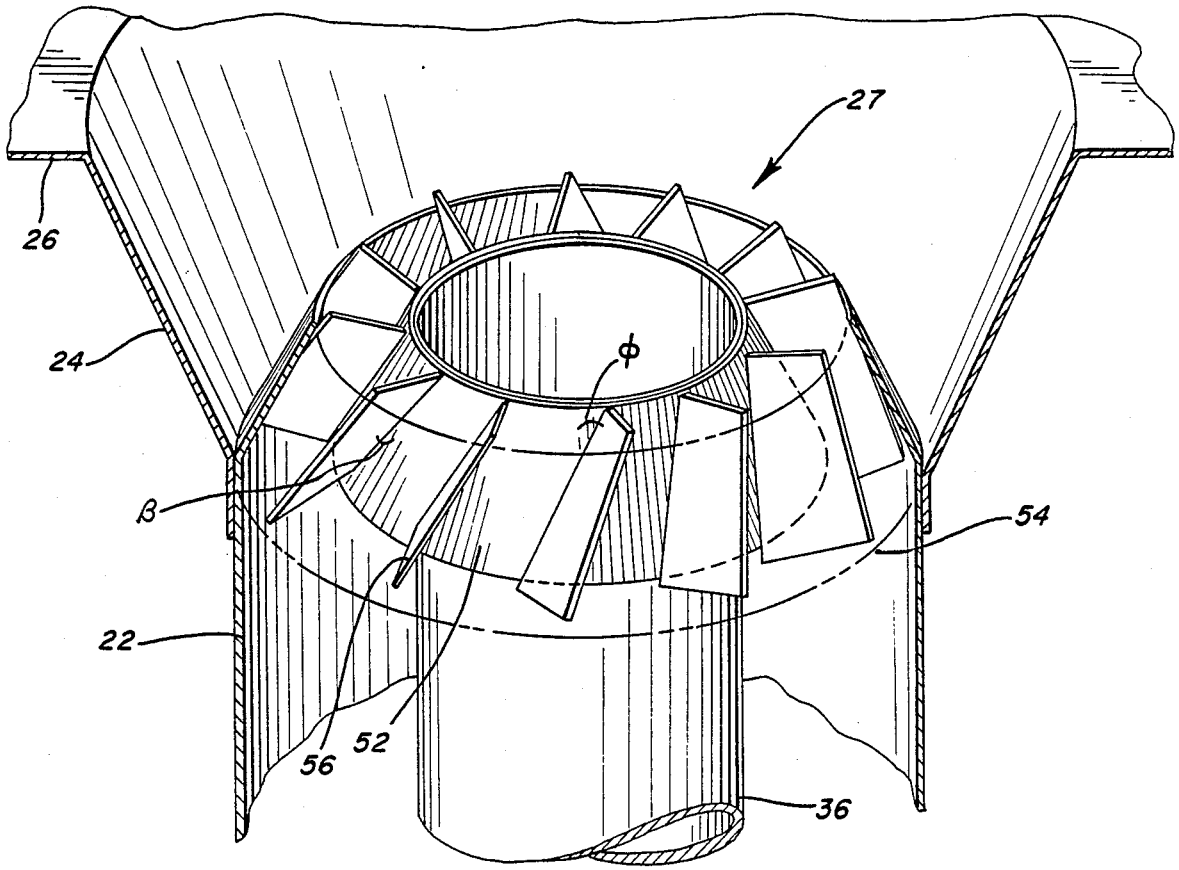
FIG. 3

SWIRL COMBUSTER BURNER

BACKGROUND OF THE INVENTION

The invention relates generally to gas burners and, more particularly, to improved high efficiency swirl combuster type gas burners for use in residential or commercial liquid heating applications such as water heaters or boilers.

Known home and commercial water heaters generally suffer from relatively low efficiency. The typical burner configuration of these devices provides a stream of combustion air. A gas pipe and nozzle are placed in the combustion air stream and gas is injected into the stream. This arrangement does not provide sufficient mixing of combustion air and gas and, as a result, has relatively lower flame temperatures requiring more fuel to heat the water. Additionally, configurations of this type result in high excess air to fuel ratios that produce undesirably high CO and $NO_x$ by-products. Because of the manner in which combustion air and gas are mixed in the known devices, and the absence of a mixing zone or cool zone above the burner face or nozzle, combustion occurs near such face or nozzle. This results in carbonization of the inner components and in turn requires heavy-duty construction for the burner assembly which is subject to excess heat and pressure.

Other known burner configurations require complicated structure in order to achieve higher efficiency. These burners require two stages of combustion air and mixing, require oxygen enriched combustion air or require relatively expensive blowers to increase the pressure of the combustion air. None of the known devices provide relatively high efficiency while having relatively simple and inexpensive construction.

High efficiency burners have been used in industrial and utility applications to heat liquids. However, the known industrial type units have not been used in home and commercial water heater applications because they are excessively expensive for home use, require complex configurations to achieve high efficiency, often require the premixing of combustion air and fuel and involve operating parameters significantly different than those in a residential hot water heater for example.

One such known device that has found application in the generation of a hot gas stream is described in U.S. Pat. No. 3,899,884 entitled "Combuster Systems" involving a gas turbine engine. The disclosure teaches a fuel spray discharge apparatus in the center of a concentric pressurized air flow chamber. This type of device teaches primary and secondary combustion air/gas mixing wherein combustion air is introduced into the gas chamber as well as above the gas chamber with the further use of discreet air jets. Thus, in order to achieve the most effective mixture of fuel and air, these devices utilize a complicated arrangement of venturi tubes and other components to achieve an effective swirl combustion effect.

U.S. Pat. No. 4,351,632, entitled "Burner With Suppressed $NO_x$ Generation" discloses another swirl type burner. In devices of this type, in order to achieve high efficiency and low undesirable emission, such as $NO_x$, primary combustion air is introduced along with gas in a combustion chamber and secondary combustion air is supplied above the combustion chamber in order to effectively impart the necessary swirling action of the fuel and air mixture. This necessitates an expensive and complicated structure that can be prone to clogging or other failure, as well as increased operating cost.

SUMMARY OF THE INVENTION

The present invention preserves the advantages of the known high efficiency burner devices. In addition, it provides new advantages not found in currently available burner devices and overcomes many of the disadvantages of the currently available burner devices.

Therefore, an object of the present invention is to provide a high efficiency swirl combuster type burner that is suitable for home or commercial applications.

Another object of the present invention is to provide a swirl combuster burner having a short turbulent flame offering clean combustion with low CO and $NO_x$ generation.

A further object of the present invention is to provide a swirl combuster burner that produces highly turbulent combustion air and fuel mixtures with a stable flame.

An additional object of the present invention is to provide a device that has a region for mixing combustion air and gas.

Yet another object of the present invention is to provide a device that ca operate at high pressures and with low pressure drops within the device.

Yet a additional object of the present invention is to provide lower construction and maintenance costs, as well as having a simple, efficient and durable design.

Yet a further object of the present invention is to provide a swirl combuster burner that produces less soot, carbon and other undesirable by-products.

Still another object of the present invention is to have combustion remote from the burner face and within the combustion chamber of a water heater tank.

Still another object of the present invention is to induce swirl of combustion gases independent of combustion air swirl and enable favorable mixing remote from the burner face.

Still an additional object of the present invention is to enable standard pressurization of gas and combustion air yet operate efficiently and at higher Btu input.

Still a further object of the present invention is to provide increased efficiency while using a relatively inexpensive blower to pressurize the combustion air.

In accordance with the present invention, a high efficiency swirl combuster gas burner is provided having a burner body which readily attaches to a tank of liquid, such as water, to be heated. The tank has an inner core or combustion chamber. A diverging burner flange is provided which leads from the burner body to the tank which defines a mixing zone. Within the burner body is an inner gas chamber and a gas piping train running through the burner body, with the gas piping train terminating with a nozzle having angular openings directed towards the sides of the inner gas chamber. A combustion air inlet is also provided on the burner body with a conduit providing combustion air from a source. Between the burner body and the inner gas chamber, within the diverging burner flange region is an air swirl cone. An ignition and flame sensing means which protrudes through the burner body and into a combustion chamber of the water tank above the region created by the diverging burner flange is also provided.

In a preferred embodiment of the swirl cone, the inner gas chamber is provided with an angular skirt ring and the burner body is provided with a flange angled toward the inner gas chamber which is parallel to the skirt ring. Positioned in the annular region between the skirt ring and the flange are a plurality of baffles. These baffles are angularly offset in relation to the vertical axis of the burner and angularly inclined in relation to a plane tangential to the skirt ring. The baffles can be secured to either the skirt ring, the flange or both. In this manner, the combustion air is made turbulent before it enters the mixing zone.

In the operation of this embodiment, combustion air is introduced into the burner body which is caused to swirl after passing through the air swirl cone and into the region defined by the diverging burner flange. Simultaneously, gas is injected through the gas piping train, through the nozzle and onto the sides of the gas chamber. This causes swirl flow of the gas on its way to the region defined by the diverging burner flange. It is only in this region that the combustion air and gas mix. The mixture is then ignited and monitored within the combustion chamber of the water heater by the ignition and flame sensing means. In this manner, the objects of the present invention are achieved.

BRIEF DESCRIPTION OF THE DRAWINGS

The novel features of the invention are set forth in the appended claims. The invention itself, however, together with further objects and attendant advantages thereof, will be best understood by reference to the following description in conjunction with the accompanying drawings wherein like references represent like elements throughout the several views, in which:

FIG. 2 is a top cross-sectional view of the present invention taken along line 2—2 of FIG. 1; and FIG. 3 is an exploded perspective view of the baffles and skirt of an embodiment of the air swirl cone.

DETAILED DESCRIPTION OF THE PREFERRED EMBODIMENTS

Figure 1:
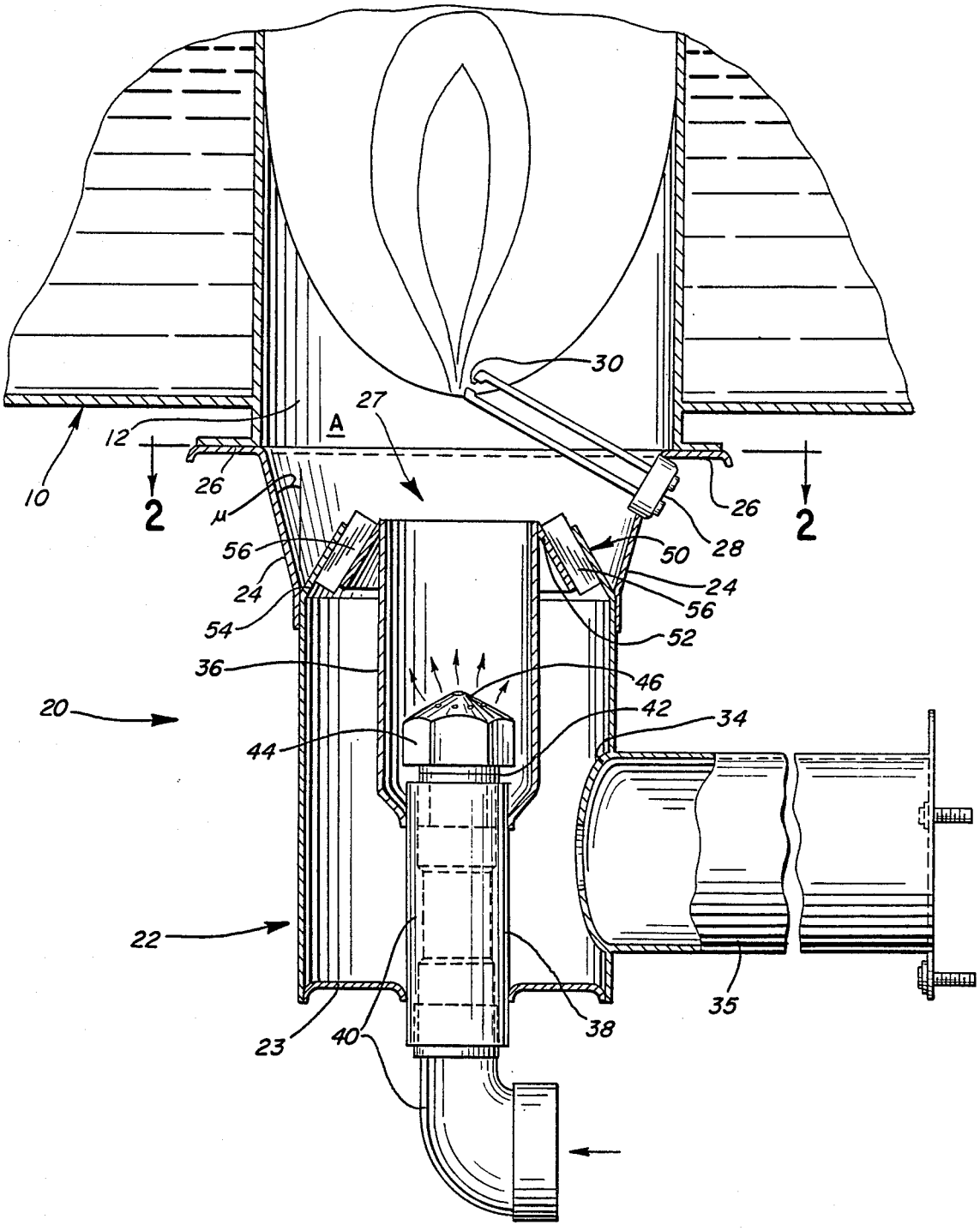
FIG. 1 is a cross-sectional view of the present invention shown attached to a water heater tank.

The swirl combuster burner of the present invention may be mounted on a variety of tanks of liquid to be heated. FIG. 1 shows a bottom portion of a conventional water heater tank 10 having a combustion chamber 12, with the present invention shown generally as 20 attached thereto.

As shown in FIG. 1, the swirl combuster burner 20 has a burner body 22 which, in this particular embodiment, is generally cylindrical but can be other shapes, such as square, depending upon the tank 10 requirements. The burner body 22 is connected to the water heater or tank 10 by a diverging burner flange 24. Diverging burner flange 24 tapers outward from the central axis of the burner body 22 and also provides a contact surface 26 for easy attachment to the tank 10. Diverging burner flange 24 is tapered at an angle of from the longitudinal centerline of burner body 22 which provides a mixing zone and allows for combustion to take place away from a burner face 27 as hereinafter described. Angle $\mu$ provides a region for gas and combustion air mixing. The magnitude of angle $\mu$ depends upon the size of combustion chamber 12 and the fuel input in order to prevent flame circulation and overheating of burner face 27. In a preferred embodiment described herein, it has been determined that an angle $\mu$ of 15° is successful, but the angle $\mu$ is not so limited. An ignition and flame sensing means 28 having an end 30 is also provided which is mounted on the burner flange 24. It will be readily understood by those of ordinary skill in the art that ignition and flame sensing means 28 can be of a variety of configurations and is commercially available. End 30 of the ignition and flame sensing means 28 protrudes into combustion chamber 12 of the water heater tank 10 and ignites a gas and combustion air mixture and senses the temperature and presence of a flame. An inlet 34 for combustion air is also provided on burner body 22. A conduit 35 provides the pressurized combustion air from a blower or other air source (not shown).

The swirl combuster burner 20 includes an inner gas chamber 36. Inner gas chamber 36 is generally cylindrical and housed within the burner body 22. The inner gas chamber 36 is smaller in diameter than the burner body 22, separates the gas from the combustion air and may be attached within the burner body by a sleeve 38. Sleeve 38 interconnects burner body 22 and inner gas chamber 36 and also provides a housing for a gas piping train 40.

Gas piping train 40 protrudes through a bottom 23 of burner body 22 and into inner gas chamber 36. Piping train 40 terminates at an end 42 in inner gas chamber 36. A nozzle 44 is connected to the end 42 and has a series of openings 46 arranged at an angle inclined toward the walls of the inner gas chamber 36. It has been determined that the openings 46 can be at a variety of angles as long as the gas is expelled to the sides of the inner gas chamber 36. However, if the openings 46 of nozzle 44 are perpendicular to the inner gas chamber 36, an undesirably high pressure drop of the gas results. An air swirl cone 50 is also provided between the burner body 22 and inner gas chamber 36 as shown generally in FIG. 1.

As shown in FIGS. 1 and 2, aft the open end of inner gas chamber 36 and around its circumference, a skirt ring 52 is provided. The skirt ring 52 is angled downward from the open end of the inner gas chamber 36 and outward toward the burner body 22. An angle of 30° from the longitudinal center axis of the burner body 22 is effective in achieving the optimum flame length and swirl of combustion air to produce a short, turbulent flame when mixed with the gas. It has been found that angles of less than 30° result in a longer flame and angles in excess of 30° result in a shorter flame. Again, 30° being the optimal for the system in relation to the other considerations as hereinbefore and hereinafter described.

A flange 54 is also provided. Flange 54 is connected to, or may be integral with burner body 22. Flange 54 is of an angle equal to that of skirt ring 52 so that it is parallel to skirt ring 52. Within the annular region between skirt ring 52 and flange 54, a plurality of vanes or baffles 56 are provided. The baffles 56 are provided to induce turbulence of the combustion air introduced through inlet 34 of burner body 22.

The arrangement of the baffles 56 can best be seen by reference to FIG. 3. In a preferred embodiment, baffles 56 are arranged along the circumference of skirt ring 52 and are sized to fit within the annular space between skirt ring 52 and flange 54. Baffles 56 are angularly offset relative to a vertical plane intersecting the longitudinal central axis of the burner body 22 shown as angle $\phi$ in FIG. 3. It has been found that an angle of 30° is effective in producing the desireable short turbulent flame. Angle $\phi$ is primarily responsible for inducing the swirl to the combustion air. As with the angle of the skirt ring 52, if this angle of offset $\phi$ is greater than 30°, too short a flame results. If the angle is less than 30°, a longer flame results.

Thus, both angles of offset $\phi$ and of skirt ring 52 of 30° produce the most favorable flame in devices having a capacity of between 30,000 and 1,000,000 BTU's per hour, which is the capacity of the preferred embodiment described herein.

Additionally, baffles 56 are inclined at an angle relative to a plane tangential to skirt ring 52 at the location of each baffle 56. The angle of the baffles 56 is shown as $\beta$ in FIG. 3, which in this embodiment is 30°. This angle of inclination $\beta$ of the baffles 56 is also responsible for inducing the swirl to the combustion air. The baffles 56 may also be perpendicular relative to a plane tangential to skirt ring 52, or $\beta$ being equal to 90°. Because baffles 56 are flat sheets and flange 54 and skirt ring 52 are curved surfaces, in order to fit baffle 56 in the annular region between flange 54 and skirt ring 52, the intersects between baffle 56 and flange 54 and between baffle 56 and skirt ring 52 are curvilinear lines. And, in an embodiment where $\beta$ is less than 90°, the angle is approximately and calculated in relation to the midpoint of baffle 56.

Thus, optimum results are achieved by the above described angles. In this manner, the favorable mixing pattern of gas and combustion air is created which results in a short, turbulent flame that is away from the components of burner body 22 and burner face 27.

Again with reference to FIG. 1, the operation of the swirl combuster burner 20 of the present invention will be understood. Combustion air is provided through conduit 35 to inlet 34 into the burner body 22. The combustion air travels past the baffles 56 which induces turbulence of the combustion air. Simultaneously, gas or other suitable fuel is supplied through gas piping train 40 and enters inner gas chamber 36. The gas passing through the angular openings 46 of nozzle 44 is forced along the sides of inner chamber 36 which induces a turbulent flow of the gas, which is isolated from the combustion air while in the inner chamber 36. The turbulent gas and turbulent combustion air mix in a region A above the burner face 27 known as a mixing zone. The mixture of gas and air rises into combustion chamber 12 and is ignited by the end 30 of ignition and flange sensing means 28 creating a short, turbulent stable flame to heat the water within the tank 10. Because of the favorable degree of turbulence induced gas/air mixing present at and the end 30 of the ignition and sensing means, the combustion chamber 12 is well above the swirl combuster assembly. And because of the mixing taking place in mixing zone A and the ignition of the combustion air and gas mixture well within the combustion chamber, carbonization of the components that occurs when the flame is too near the burner face is reduced. Also, because combustion occurs well within the combustion chamber 12, heavy duty components are not required which, in turn, reduces the cost of the burner 20.

Additionally, this arrangement provides a greatly reduced excess air to gas ratio and can operate under high pressure, thereby reducing the generation of CO and $NO_x$. As a result of the favorable turbulent mixture of gas and combustion air, a stable short flame is achieved. This provides for increased operational efficiency.

In the preferred embodiment, twelve (12) baffles 56 are utilized. Additional baffles 56 may be employed, but increases the cost of the device as a result of higher material costs.

Again, because of the favorable mixing of gas and combustion air at a location remote from the burner face 27, and the highly turbulent air induced by the air swirl cone 50, a standard blower or air source to provide pressurized combustion air may be utilized. Thus, high efficiency is achieved without having to resort to expensive blowers to provide combustion air at increased pressure.

Finally, because the gas swirl is induced separately from the combustion air a lower pressure is created within that region. This lower pressure enables a higher gas flow to be introduced. This allows the system to generate higher Btu capacity.

It will be understood that the invention may be embodied in other specific forms without departing from the spirit or central characteristics of the invention. The described examples and embodiments therefore are to be considered as merely illustrative and not restrictive, and the invention is not to be limited to the details given herein.

What is claimed is:

1. An improved high efficiency swirl combuster burner for heating liquid within a tank having a combustion chamber, said burner comprising;

a burner body having an inlet for combustion air;

a diverging burner flange tapering from the burner body to the tank;

an inner gas chamber located within said burner body;

a gas piping train passing through the burner body terminating at an end within the inner gas chamber;

a nozzle having openings angled toward the wall of the inner gas chamber connected to the end of the gas piping train;

an air swirl cone located between the burner body and inner gas chamber; and an ignition and flame sensing means mounted on the burner body and protruding into the combustion chamber.

2. The apparatus of claim 1 wherein said air swirl cone comprises:

a skirt ring attached to the inner gas chamber and angled toward the burner body;

a flange on the burner body angled toward the inner gas chamber and parallel to the skirt ring; and a plurality of baffles positioned in the annular region between the skirt ring and flange.

3. The apparatus of claim 2 wherein the baffles are offset at an angle from the longitudinal center axis of the burner body.

4. The apparatus of claim 3 wherein the baffles are generally perpendicular in relation to a plane tangential to the skirt ring.

5. The apparatus of claim 3 wherein the angle of offset of the baffles is 30°.

6. An improved high efficiency swirl combuster burner for use in heating liquid in a tank, said burner comprising:

a generally cylindrical burner body;

a generally cylindrical inner gas chamber concentrically housed within said burner body having a smaller diameter than said burner body a gas piping train extending through said burner body and terminating in said inner gas chamber;

a diverging burner flange interconnecting said burner body and a source of liquid to be heated;

a gas nozzle connected to an end of gas piping train to direct gas into said inner gas chamber;

a combustion air inlet connected to said body;

an air swirl cone between said burner body and inner gas chamber; and, an ignition and spark sensing means.

7. The apparatus of claim 6 wherein the air swirl cone comprises:

a skirt ring to connect to the inner gas chamber and angled toward the burner body;

a flange connected to the burner body and angled toward the inner gas chamber and parallel to the skirt ring; and a plurality of baffles positioned within the annular space created by the skirt ring, said baffles being offset at an angle from the longitudinal central axis of the burner body and said baffles being generally perpendicular to a plane tangential to the skirt ring.

8. The apparatus of claim 7 wherein the angle of offset of the baffles is 30°.

9. The apparatus of claim 8 wherein the baffles are inclined at an angle relative to a plane tangential to the skirt ring.

* * * * *